US010920419B2

(12) United States Patent
Kaump

(10) Patent No.: US 10,920,419 B2
(45) Date of Patent: Feb. 16, 2021

(54) CEILING TILES

(71) Applicant: Modular Arts, Inc., Seattle, WA (US)

(72) Inventor: Donald L. Kaump, Seattle, WA (US)

(73) Assignee: MODULAR ARTS, INC., Seattle, WA (US)

( * ) Notice: Subject to any disclaimer, the term of this patent is extended or adjusted under 35 U.S.C. 154(b) by 0 days.

(21) Appl. No.: 16/512,118

(22) Filed: Jul. 15, 2019

(65) Prior Publication Data

US 2020/0018066 A1 Jan. 16, 2020

Related U.S. Application Data

(60) Provisional application No. 62/698,724, filed on Jul. 16, 2018.

(51) Int. Cl.
*E04B 9/04* (2006.01)
*E04B 9/24* (2006.01)
(Continued)

(52) U.S. Cl.
CPC ..... *E04B 9/0428* (2013.01); *E04B 9/001* (2013.01); *E04B 9/006* (2013.01); *E04B 9/0435* (2013.01);
(Continued)

(58) Field of Classification Search
CPC .... E04B 9/0428; E04B 9/0464; E04B 9/0435; E04B 9/248; E04B 9/001; E04B 9/006;
(Continued)

(56) References Cited

U.S. PATENT DOCUMENTS 2,939,543 A * 6/1960 Zingone ..... E04B 9/18 52/145
3,996,458 A * 12/1976 Jones ..... E04B 9/045 362/290
(Continued)

FOREIGN PATENT DOCUMENTS

WO 2006/026575 A2 3/2006

OTHER PUBLICATIONS

International Search Report and Written Opinion for International Application PCT/US2019/041881, dated Oct. 14, 2019. 12 pages.

*Primary Examiner* — Jessie T Fonseca
(74) *Attorney, Agent, or Firm* — Seed Intellectual Property Law Group LLP

(57) ABSTRACT

A ceiling structure includes a suspended framework having a plurality of main runners and a plurality of cross runners interconnected to define an array of tile receiving openings, each of the plurality of main runners and the plurality of cross runners including a tile mating surface facing downward to define a mounting frame at each respective tile receiving opening, and a plurality of ceiling tiles positioned within the array of tile receiving openings, each of the plurality of ceiling tiles having a main body. The main body of the ceiling tile includes a base having a periphery, a plurality of magnets positioned at the periphery and sized and shaped to magnetically couple the ceiling tile within a respective one of the tile receiving openings, and a plurality of baffles coupled to the base, each baffle being spaced apart from the other. Related methods, systems, and ceiling tiles are also provided.

17 Claims, 18 Drawing Sheets

(51) Int. Cl.
*E04B 9/00* (2006.01)
*F21S 2/00* (2016.01)

(52) U.S. Cl.
CPC ..... *E04B 9/0464* (2013.01); *E04B 9/248* (2013.01); *F21S 2/005* (2013.01)

(58) Field of Classification Search
CPC ..... F21V 11/00; F21S 2/005; F21Y 2115/10; F21Y 2103/10
See application file for complete search history.

(56) References Cited

U.S. PATENT DOCUMENTS

| | | | | |
|---|---|---|---|---|
| 5,414,969 | A * | 5/1995 | Krejci | E04B 9/064 156/71 |
| 5,806,972 | A * | 9/1998 | Kaiser | F21S 8/02 362/290 |
| 9,163,402 | B2 * | 10/2015 | Kabatsi | E04B 9/345 |
| 9,175,473 | B2 | 11/2015 | Kaump | |
| 10,407,904 | B2 * | 9/2019 | Gillette | E04B 9/248 |
| 2008/0266843 | A1 * | 10/2008 | Villard | E04B 9/32 362/147 |
| 2015/0047293 | A1 * | 2/2015 | Kaump | E04B 9/127 52/764 |
| 2018/0283004 | A1 * | 10/2018 | Gillette | E04B 9/001 |
| 2018/0363295 | A1 * | 12/2018 | Gillette | E04B 9/0464 |

* cited by examiner

CEILING TILES

BACKGROUND

Technical Field

The present disclosure relates to ceiling structures, and more particularly, to ceiling tiles for constructing a ceiling structure, and systems and methods for assembling the same.

Description of the Related Art

Conventional suspended ceiling structures are constructed by assembling a ceiling structure grid above a floor and at the upper end of walls that form a boundary around residential or commercial space. The ceiling structure grid primarily includes a plurality of main runners and cross runners, which may be suspended by wires or the like from the overhead structure above. The pluralities of main runners and cross runners are generally oriented to be perpendicular to each other. The plurality of main runners and cross runners are each spatially spaced apart and interconnect at positions of intersection, which defines an opening to receive ceiling tiles. Conventional ceiling tiles are positioned within such openings from above, and rest on the grid in a non-secured manner. Construction and assembly of such conventional suspended ceiling structures can be complicated, time consuming, laborious, and may not result in an aesthetically pleasing ceiling.

U.S. Pat. No. 9,175,473, owned by Applicant, which is incorporated by reference herein in its entirety, provides ceiling tile systems with robust and efficient form factors that allow ceiling tiles to be coupled to ceiling frameworks via magnetic coupling to ease installation and uninstallation. It is desirable, moreover, to have ceiling tile systems that may improve lighting in rooms with limited ambient lighting, provide certain aesthetically appealing lighting schemes, and control and optimize environmental noise.

BRIEF SUMMARY

Embodiments described herein provide simple, efficient systems, tiles, and methods for constructing and assembling ceiling structures that improve ambient lighting, control and optimize environmental noise, and provide aesthetically appealing structures.

For example, according to one embodiment, a ceiling structure can be summarized as including a suspended framework having a plurality of main runners and a plurality of cross runners interconnected to define an array of tile receiving openings, each of the plurality of main runners and the plurality of cross runners including a tile mating surface facing downward to define a mounting frame at each respective tile receiving opening, and a plurality of ceiling tiles positioned within the array of tile receiving openings, each of the plurality of ceiling tiles having a main body. The main body of the ceiling tile may include a base having a periphery, a plurality of magnets positioned at the periphery and sized and shaped to magnetically couple the ceiling tile within a respective one of the tile receiving openings, and a plurality of baffles coupled to the base, each baffle being spaced apart from the other.

According to another embodiment, a ceiling tile can be summarized as including a base having a periphery, one or more magnets positioned at the periphery and sized and shaped to magnetically couple the ceiling tile to a ceiling structure, and a plurality of baffles coupled to the base, each baffle being spaced apart from the other.

According to another embodiment, a method for assembling a ceiling structure can be summarized as including constructing a suspended framework having a plurality of main runners and a plurality of cross runners interconnected to define an array of tile receiving positions, magnetically coupling a plurality of ceiling tiles to the suspended framework with a respective ceiling tile located at each tile receiving position, coupling a light source to at least one of the plurality of ceiling tiles, the light source configured to illuminate an environment in which the ceiling tiles are located, and electrically coupling the light source to an external power supply.

DETAILED DESCRIPTION

Figure 1:
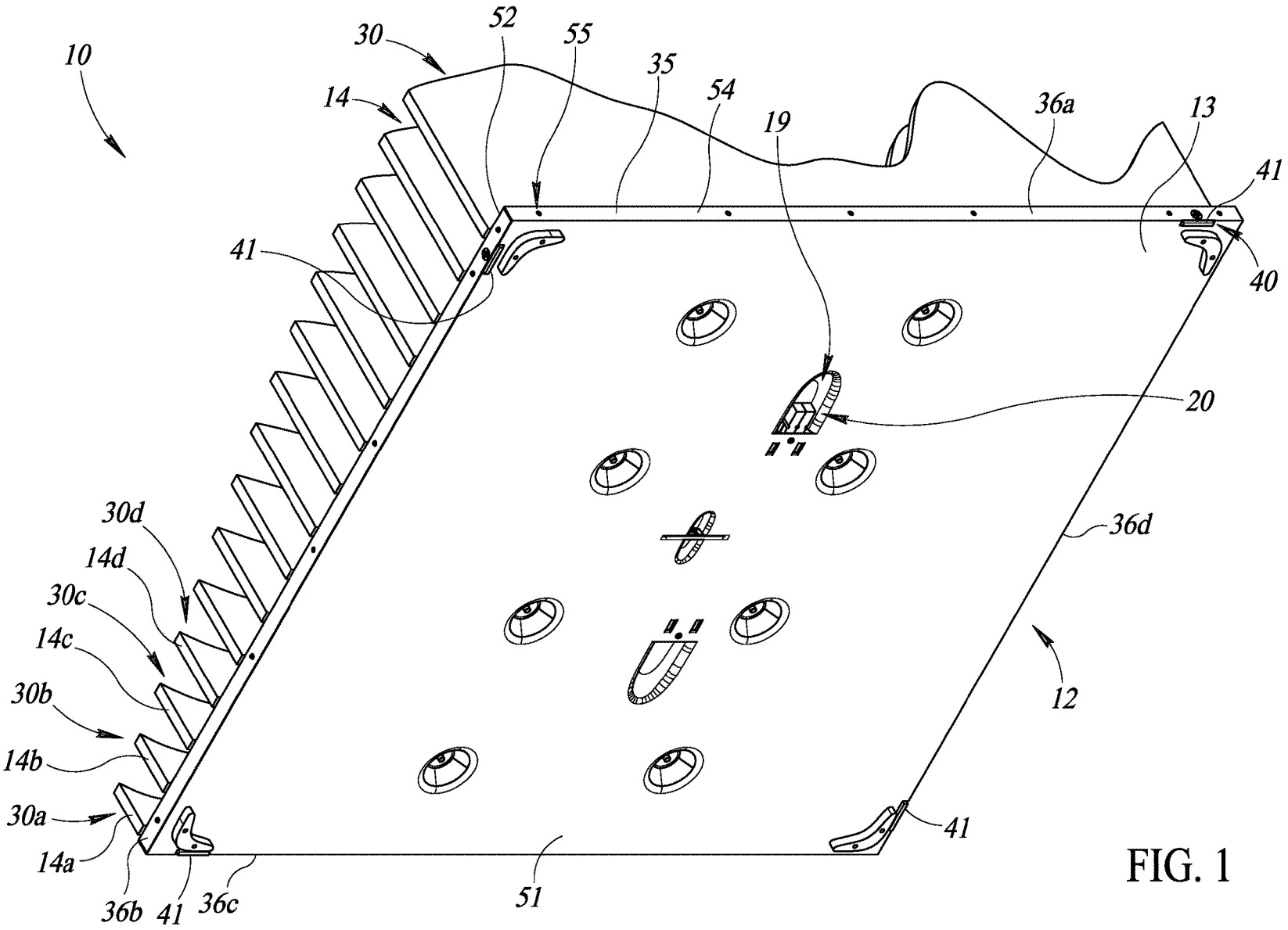
FIG. 1 is a perspective view of a ceiling tile, according to one example, non-limiting embodiment.
Figure 2:
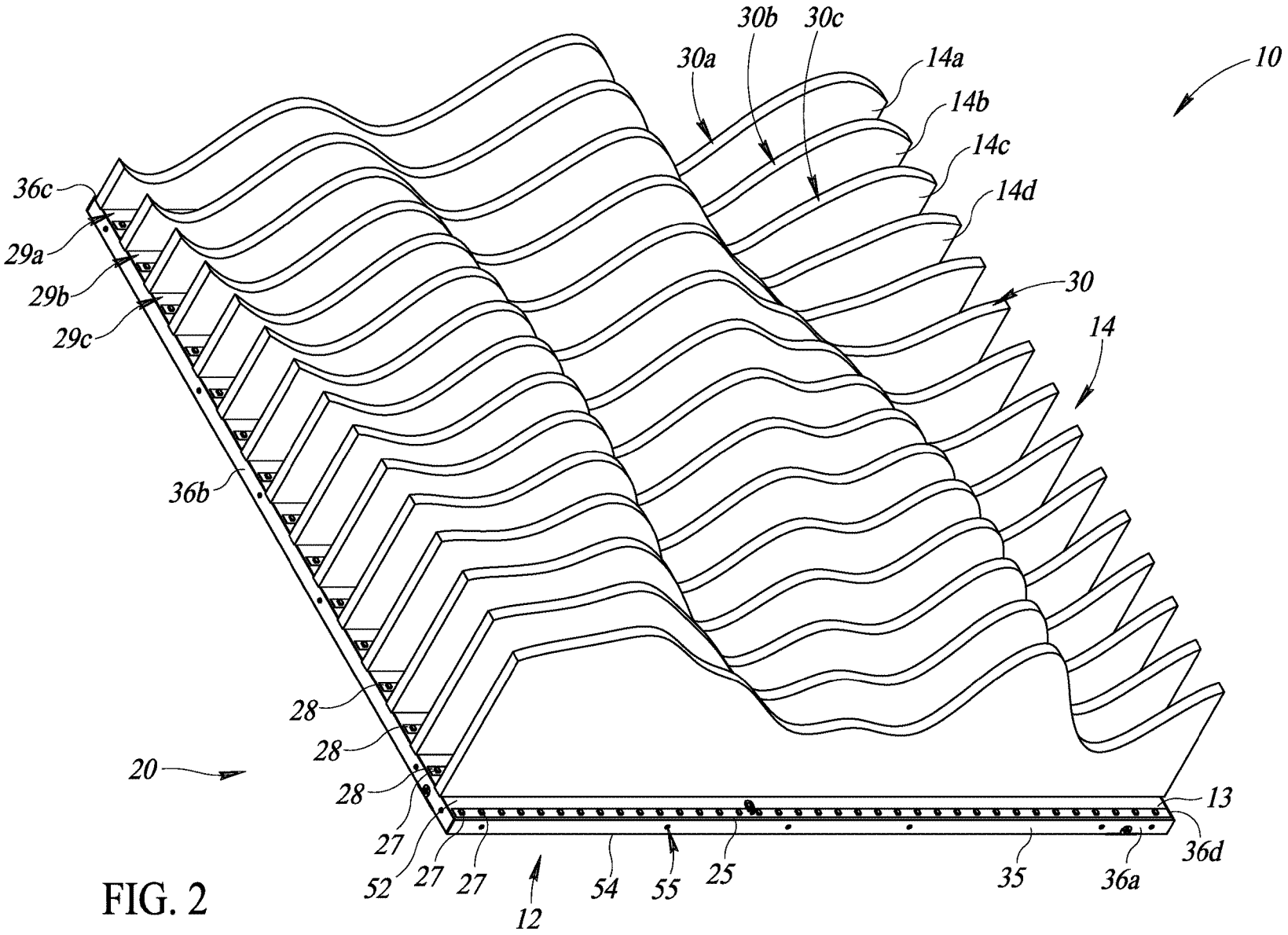
FIG. 2 is another perspective view of the ceiling tile of FIG. 1.
Figure 3:
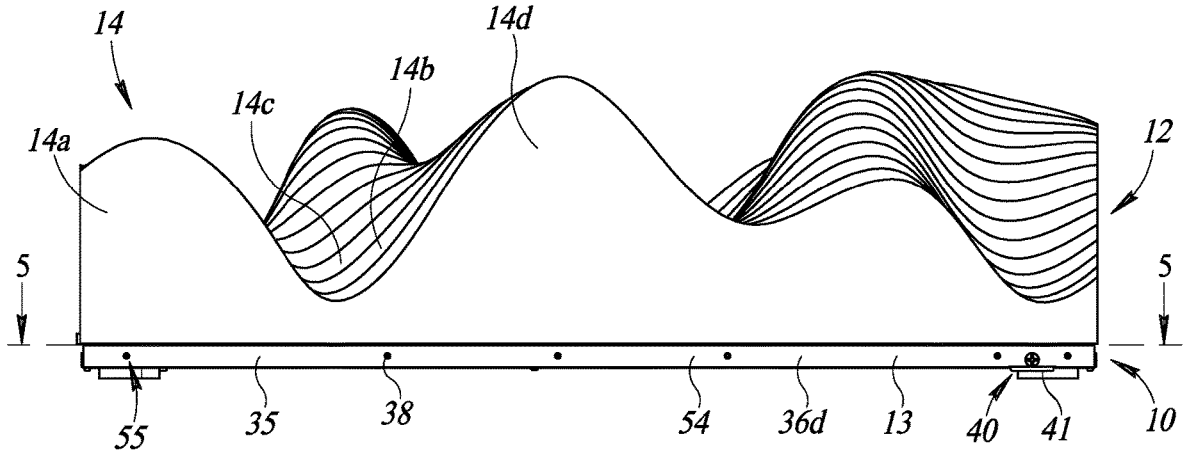
FIG. 3 is an inverted front elevational view of the ceiling tile of FIG. 1.
Figure 4:
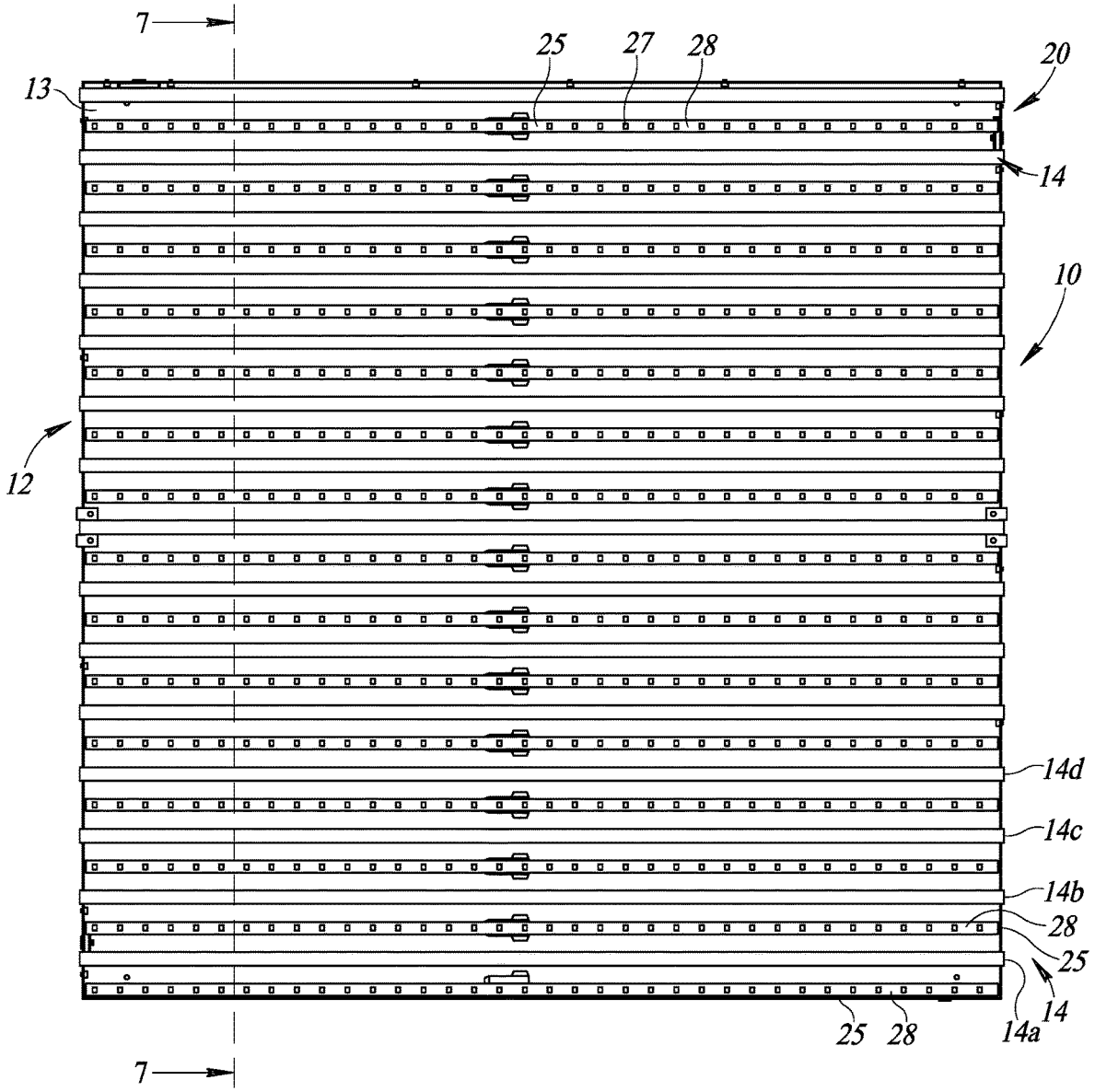
FIG. 4 is a bottom plan view of the ceiling tile of FIG. 1, as viewed looking up to the ceiling tile.
Figure 5:
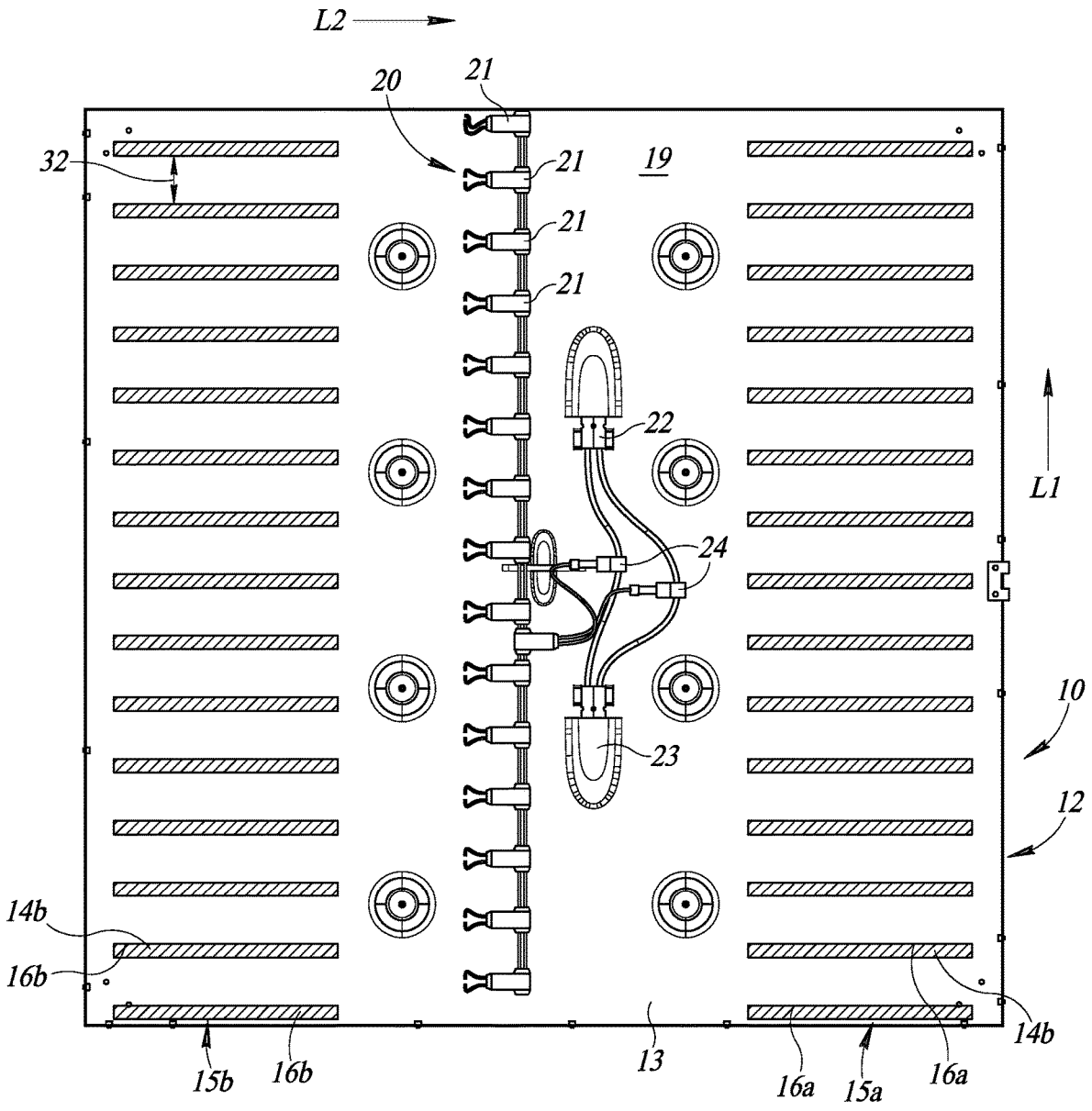
FIG. 5 is a cross-sectional view of the ceiling tile of FIG. 1, taken along lines 5-5 of FIG. 3.
Figure 6:
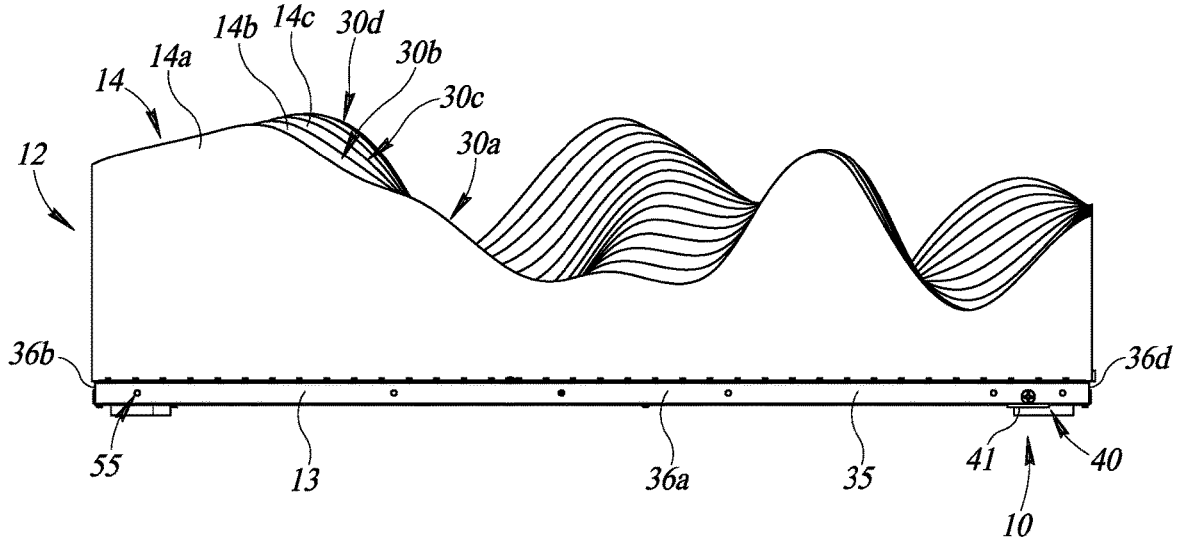
FIG. 6 is an inverted rear elevational view of the ceiling tile of FIG. 1.

In the following description, certain specific details are set forth in order to provide a thorough understanding of various disclosed embodiments. However, one skilled in the relevant art will recognize that embodiments may be practiced without one or more of these specific details. In other instances, well-known structures and methods associated with suspended ceiling tile systems and ceiling tiles may not be shown or described in detail to avoid unnecessarily obscuring descriptions of the embodiments.

Unless the context requires otherwise, throughout the specification and claims which follow, the word "comprise" and variations thereof, such as "comprises" and "comprising," are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

FIGS. 1-7 illustrate a ceiling tile 10, according to one example, non-limiting embodiment. The ceiling tile 10 includes a main body 12 that is sized and shaped to be received in suspended framework of a ceiling structure, as described in more detail below. The main body 12 includes a base 13 and a plurality of baffles 14 (14*a*, 14*b*, 14*c* . . . 14*n*, collectively referred to herein as baffles 14). The baffles 14 are coupled to the main body 12 via corresponding first and second recesses 15*a*, 15*b* disposed in the base 13. Each first recess 15*a* is spaced apart from the other in a longitudinal direction L1, and each second recess 15*b* is spaced apart from the other in the longitudinal direction L1. In some embodiments, the first and second recesses 15*a*, 15*b* may be spaced apart equally or unequally in the longitudinal direction L1. In a lateral direction L2, the first recesses 15*a* are spaced apart from the second recesses 15*b*. Again, the first recesses 15*a* may be spaced apart from the second recesses 15*b* in the lateral direction L2 equally or unequally.

Each of the first and second recesses 15*a*, 15*b* is sized and shaped to coupleably receive the baffles 14. In particular, the baffles 14 include first tabs 16*a* and second tabs 16*b*. The first and second tabs 16*a*, 16*b* extend or protrude outwardly from base surfaces of the baffles 14 and are sized and shaped to be received in the corresponding first and second recesses 15*a*, 15*b*. Proximate to each first and second recess 15*a*, 15*b*, the base 13 includes a pair of securing tabs 17*a*, 17*b* that surround and secure the first and second tabs 16*a*, 16*b* of the baffles 14.

Figure 7:
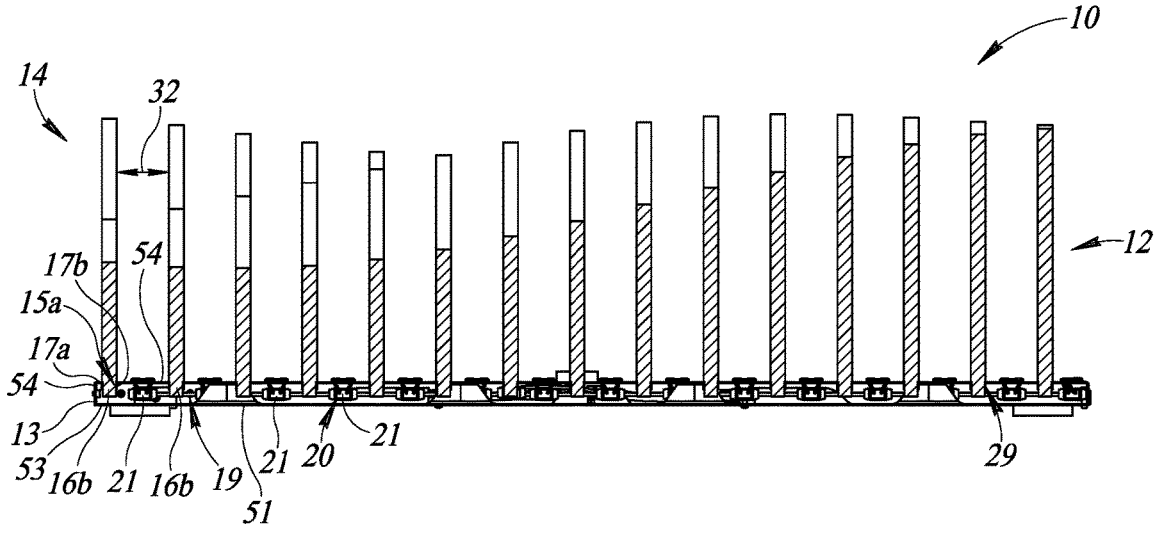
FIG. 7 is a cross-sectional view of the ceiling tile of FIG. 1, taken along lines 7-7 of FIG. 4.

As illustrated in FIGS. 1-7, the base 13 is generally hollow with a cavity 19 that is sized and shaped to receive therein components of the ceiling tile 10. For example, as illustrated in FIG. 7, the securing tabs 17*a*, 17*b* extend into the cavity 19. Similarly, the ceiling tile 10 includes an electrical system 20, components of which are generally disposed in the cavity 19, and which is configured to transmit power from an external power supply to electrical components of the ceiling tile 10. In particular, the electrical system 20 includes a plurality of splice connectors 21 that are electrically coupled to each other. For example, each of the splice connectors 21 is coupled to the other via hardwiring. Each splice connectors 21 is configured to deliver or transmit power to a light source 25, as described in more detail below. The electrical system 20 further includes an input connector 22 and an output connector 23. The input connector 22 is configured to receive a supply of power, which may be delivered from an external power supply or from another output connector 23. The output connector 23 is electrically coupled to the input connector 22 and configured to deliver power supply to another input connector 22. The electrical system 20 further includes one or more wire connectors 24 that deliver power being received from the external power supply to the splice connectors 21.

Each of the splice connectors 21 is coupled to a corresponding light source 25 that is generally configured to illuminate the ceiling tile 10 or an environment in which the ceiling tile 10 is located. In some implementations, the light source 25 may take the form of one or more light emitting diodes (LED) 27, e.g., Red, Green, Blue ("RGB") LEDs, that can be disposed in LED strips 28. In other implementations, the light source 25 may take other forms, such as incandescent lights, fluorescent lights, compact fluorescent lights, and other light emitting elements that may illuminate the ceiling tile 10, or an environment. The light source 25, for example, LED strip 28, is positioned between each of the baffles 14. In some implementations, the LED strips 28 may be coupled to the base 13 via adhering, fasteners, or other coupling structures. In some implementations, the base 13 may include recesses sized and shaped to receive the LED strips 28. Moreover, in some implementations, the LED strips 28 may be positioned within housings that include one or more diffuser materials that diffuse light rays emitted by the LED strips 28.

As described above, the light sources 25 are configured to emit light to illuminate the ceiling tile 10 and/or an environment in which the ceiling tile 10 is located. For example, in some implementations, the light sources 25 may illuminate the ceiling tile 10 and/or the environment in a certain color, such as red, green, blue, etc. In some implementations, the light sources 25 may be configured to generate certain lighting schemes, for example, animated lighting schemes.

The baffles 14 are sized and shaped to provide an aesthetically appealing shape to a ceiling structure while having a complex compound shape that improves acoustical absorption of noise in an environment in which the ceiling tile 10 is located. For example, each baffle, e.g., 14*a*, 14*b*, 14*c* . . . 14*n*, includes a base surface, e.g., base surface 29*a*, 29*b*, 29*c* . . . 29*n* (collectively referred to herein as base surface 29), that is relatively flat and from which the first tabs 16*a* and second tabs 16*b* extend or protrude outwardly. An opposing, edge surface, e.g., 30*a*, 30*b*, 30*c* . . . 30*n* (collectively referred to herein as edge surface 30) has a complex compound shape. The complex compound shape of the edge surface 30 is sized and shaped to provide an aesthetic appeal to the ceiling tile 10. Moreover, the edge surface of each of the baffles, e.g., edge surface 30*a*, 30*b*, 30*c* . . . 30*n*, has a distinct shape which defines a surface area of each baffle, e.g., baffle 14*a*, 14*b*, 14*c* . . . 14*n*, that, in some implementations, may be different from the other baffles. For example, in some implementations, the surface area of baffle 14*a* may be less than the surface area of baffle 14*b*, and similarly the surface areas of the other baffles may increase in the longitudinal direction L1. Such varying surface areas of the baffles 14 may be configured to gradually increase the surface area exposed to sound, which tends to reduce reverberation, and thus improves sound absorption.

In some implementations, the baffles 14 are spaced apart from each other to define an acoustical gap 32. The acoustical gap 32 is sized and shaped to improve sound suppression capability of the ceiling tile 10 via resonance between the baffles 14 at a certain defined frequency attributable to the acoustical gap 32. As shown in FIGS. 1-7, the LED strips 28 are positioned within the acoustical gap 32.

In addition to the sizes, shapes, and/or locations of the baffles 14 described above, each baffle 14 may comprise a polyethylene terephthalate (PET) thermoplastic resin, which in combination with the sizes, shapes, and/or locations of the baffles 14, improves sound absorption quality of the ceiling tile 10. In some implementations, the baffles 14 may comprise other materials that improve sound absorption, such as various forms of fiberglass, acoustic foam, and/or recycled cotton.

The ceiling tile 10 includes a peripheral portion 35 that is disposed around a periphery of the base 13. The peripheral portion 35 is defined by sides 36*a*, 36*b*, 36*c*, 36*d* of the base 13. In particular, the base 13 includes a first body 51 and a second body 52. The first body 51 includes wall portions 53 and the second body 52 includes wall portions 54 that are coupled to each other via one or more fasteners 55, e.g., rivets. The wall portions 53 of the first body 51 and the wall portions 54 of the second body 51, when coupled together with the fasteners 55, form sides 36*a*, 36*b*, 36*d* of the base 13.

In some implementations, the peripheral portion 35 includes one or more receptacles 40 disposed in the sides 36*a*, 36*b*, 36*d*, 36*d* of the base 13. The one or more receptacles 40 is sized and shaped to coupleably receive a corresponding magnet 41. The magnet 41, in some implementations, may take the form of a square or a rectangular magnet. In other implementations, the magnet 41 may take the form of a radial magnet, which is diametrically magnetized to produce a magnetic force in a direction that is substantially normal to a planar surface of the base 13, e.g., base surface 29 or edge surface 30.

As described above, a plurality of ceiling tiles 10 are configured to be coupleably received in a suspended frame. FIGS. 8-12 illustrate a ceiling structure 200 that includes a suspended framework 202 and a plurality of ceiling tiles 10. The suspended framework 202 is generally suspended from an overhead structure (not shown) by hanging wires, braces or other structures that couple the suspended framework 202 to the overhead structure. The suspended framework 202 includes a plurality of main runners 222 that are spatially spaced apart and are substantially parallel to each other. The suspended framework 202 further includes a plurality of cross runners 224 that are spatially spaced apart and are substantially parallel to each other, but are oriented to be substantially perpendicular to the plurality of main runners 222. The main runners 222 and the cross runners 224 may be manufactured from extrusions having various cross-sectional profiles.

The cross runners 224 are coupled to the main runners 222 in a known manner. The coupling of the cross runners 224 to the main runners 222 defines tile receiving openings 210. The area of each of the tile receiving openings 210 (i.e., width and length) depends on the spacing of the main runners 222 and the cross runners 224. This spacing can be adjustable based on the areas of the ceiling tiles 10 that are to be positioned within the tile receiving openings 210, such that the ceiling tiles 10 substantially cover or overlay the tile receiving openings 210. Each tile receiving opening 210 also defines a mounting frame 228 that bounds the tile receiving opening 210 and includes mating surfaces 290 that generally face downward, i.e., facing a floor structure of an interior of a room or space. The mating surfaces 290 may be defined by base flanges of the main runners 222 and the cross runners 224, to which the ceiling tiles 10 are coupled.

The main runners 222 and the cross runners 224 are generally made from steel or other ferromagnetic materials. Thus, when the ceiling tiles 10 are positioned within the tile receiving openings 210, the magnetic force produced by the magnet(s) 41 is sufficient to magnetically couple the ceiling tile 10 to the suspended framework 202. In some implementations, the ceiling structure 200 may include a gasket that may be positioned between the main runners 222 and the cross runners 224. The gasket may be positioned around boundaries of the ceiling tiles 10.

Figure 8:
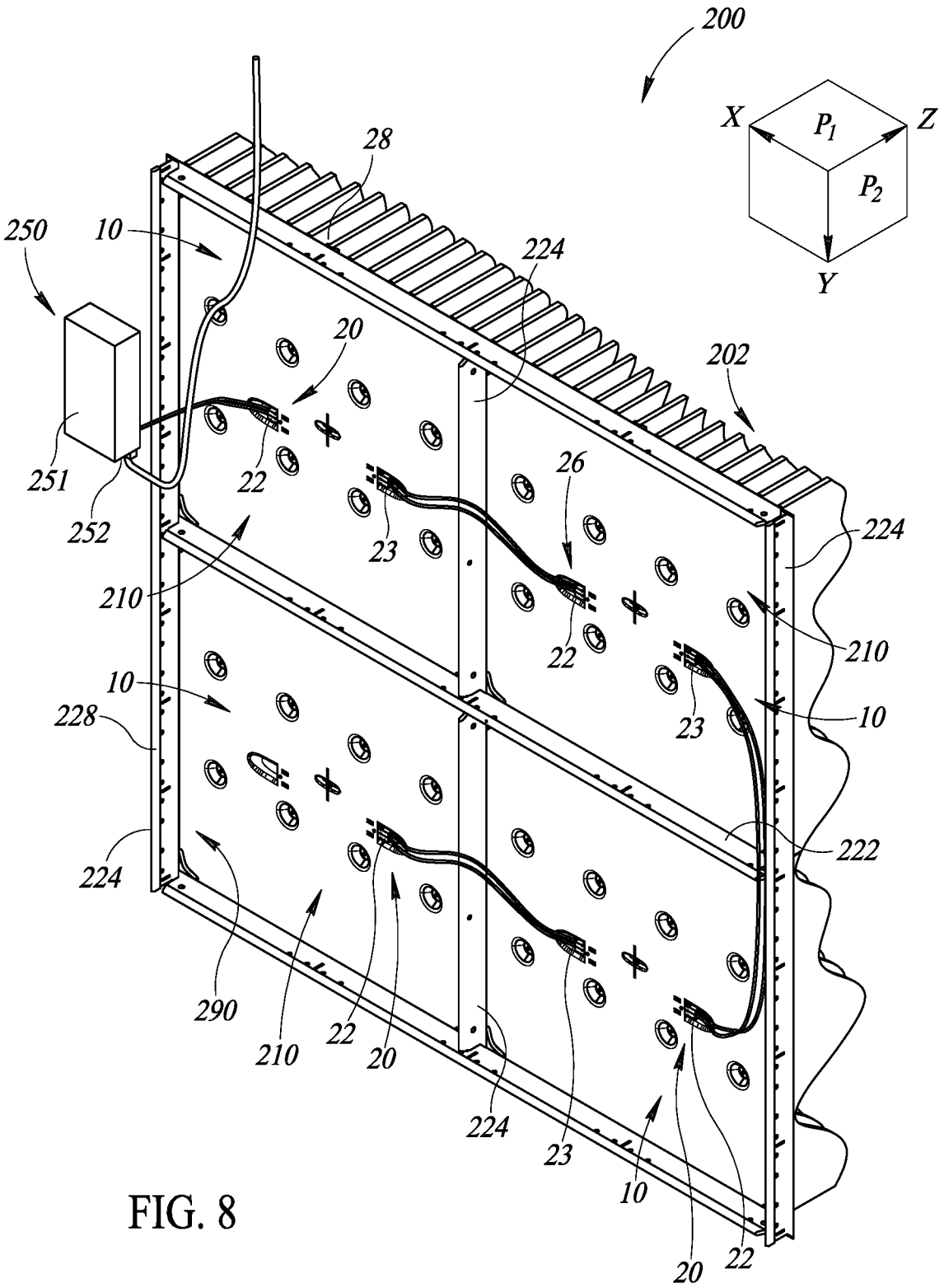
FIG. 8 is a perspective view of a ceiling structure, according to one example, non-limiting embodiment.
Figure 9:
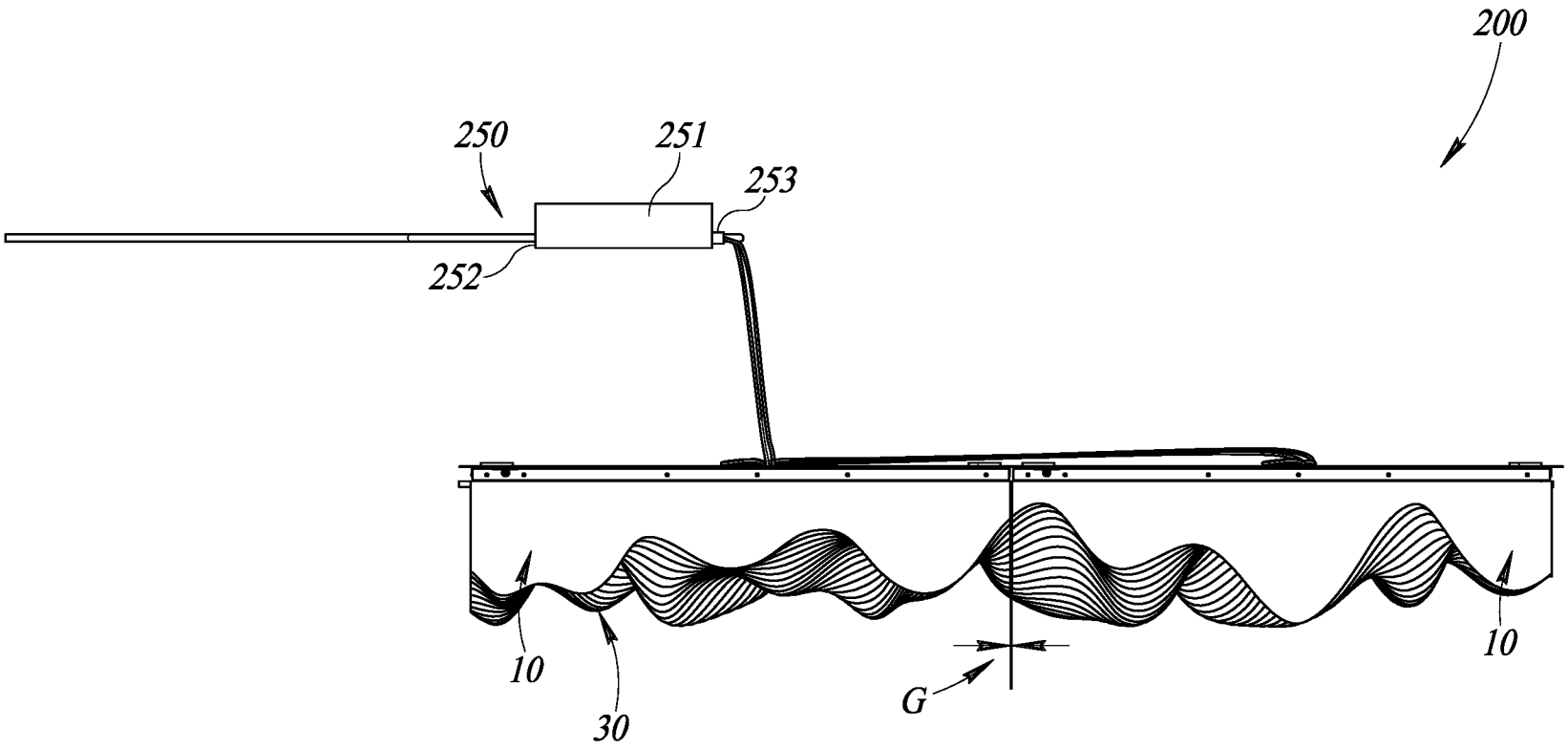
FIG. 9 is a front elevational view of the ceiling structure of FIG. 8, with portions of a suspended framework removed for clarity of illustration and description.
Figure 10:
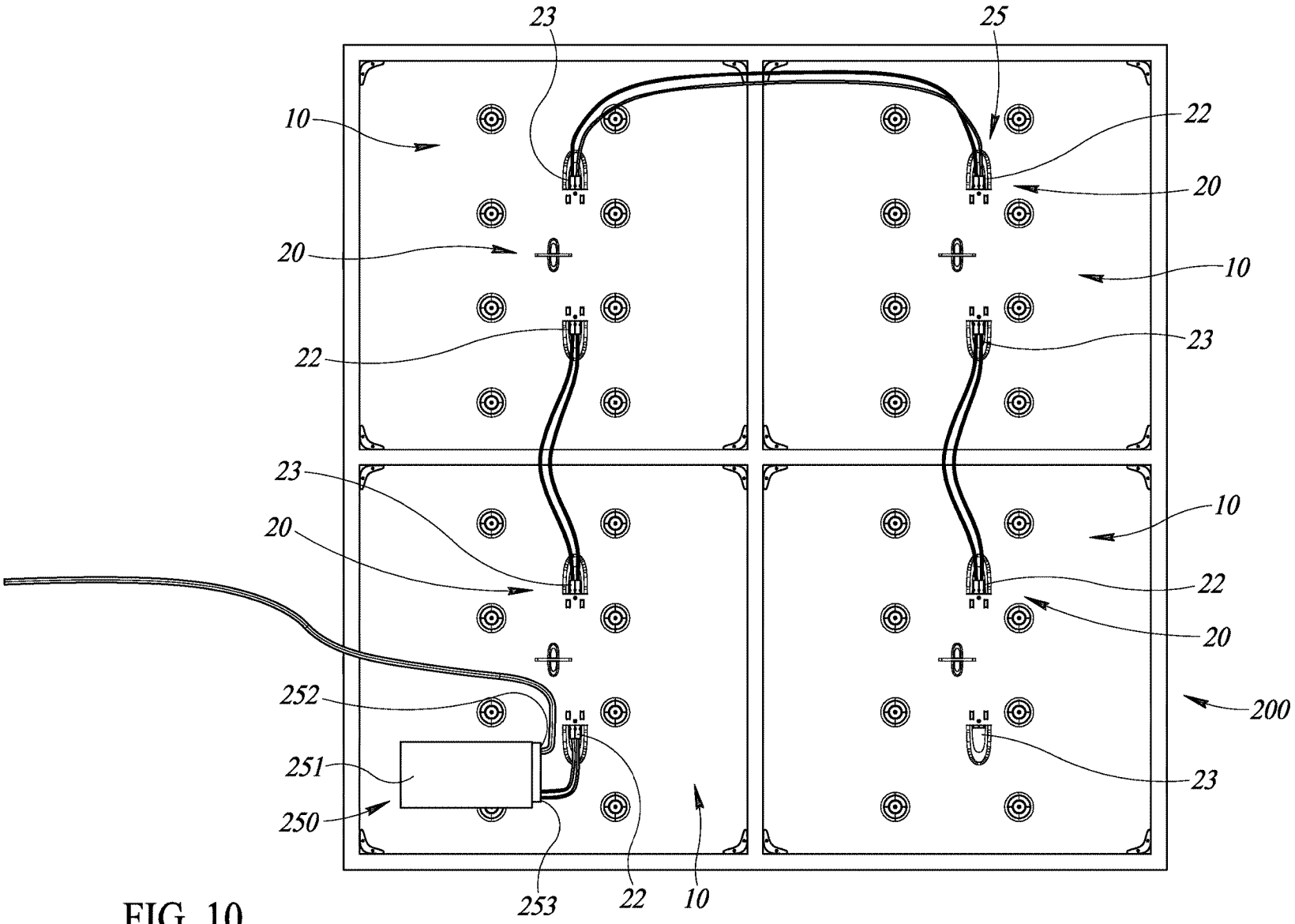
FIG. 10 is a top plan view of the ceiling structure of FIG. 8 as viewed looking down to the ceiling structure, with portions of a suspended framework removed for clarity of illustration and description.
Figure 11:
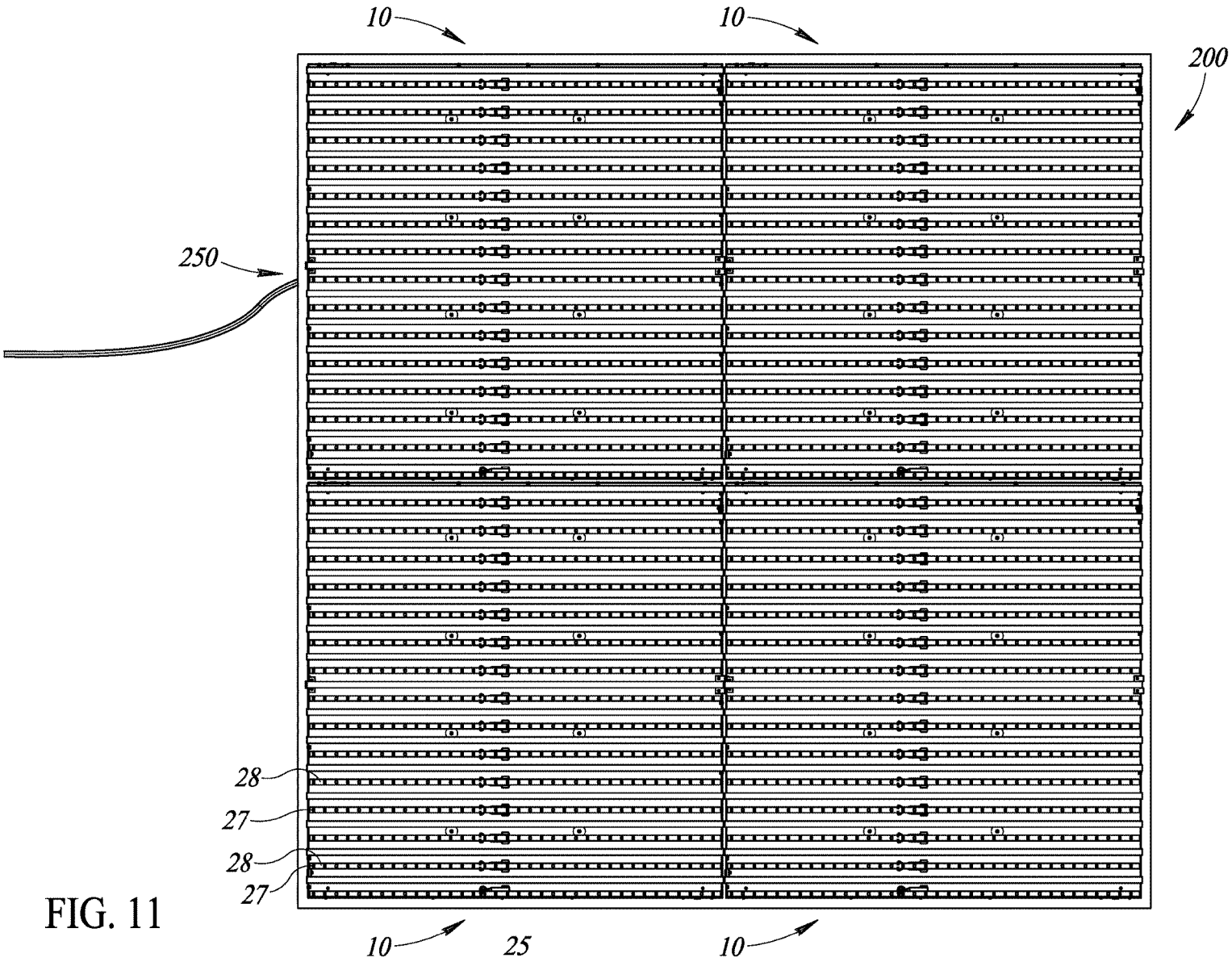
FIG. 11 is a bottom plan view of the ceiling structure of FIG. 8 as viewed looking up to the ceiling structure, with portions of a suspended framework removed for clarity of illustration and description.
Figure 12:
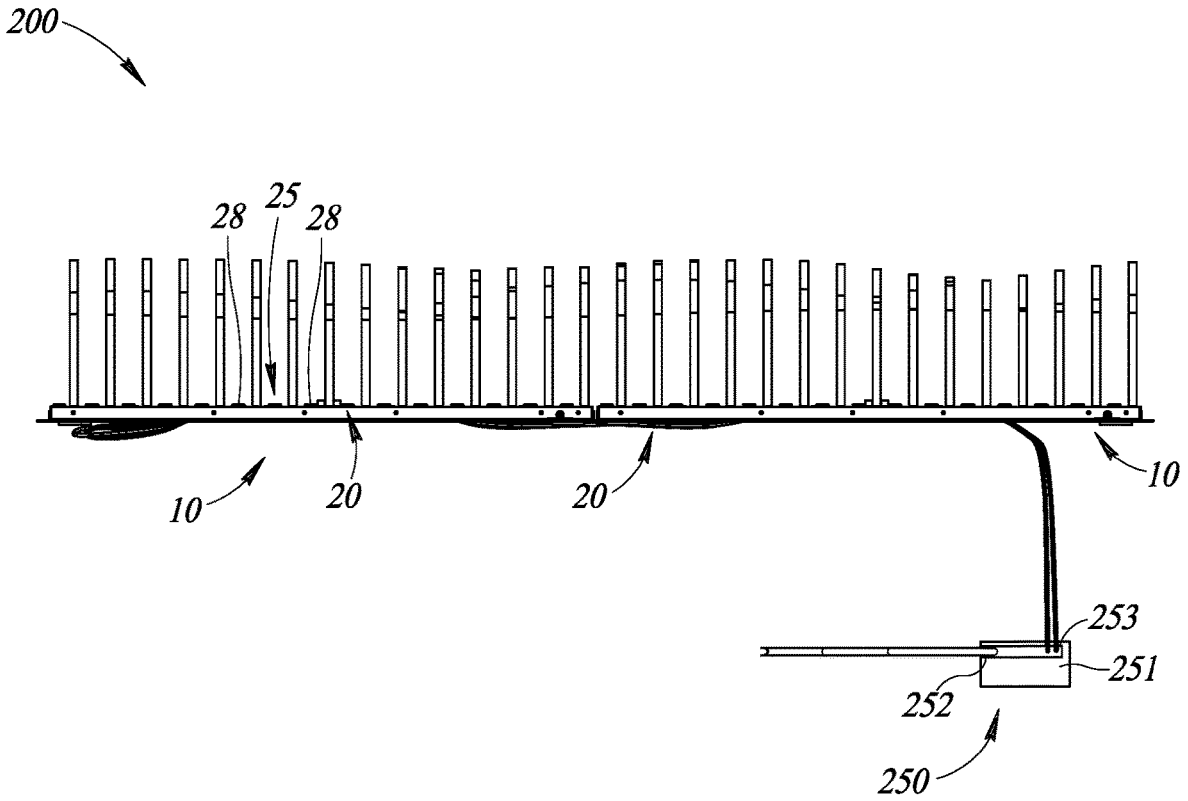
FIG. 12 is a side elevational view of the ceiling structure of FIG. 8, with portions of a suspended framework removed for clarity of illustration and description.

With reference to FIGS. 9 through 12 in which portions of the suspended framework 202 have been removed for clarity of illustration and description, and continued reference to FIG. 8, the ceiling tiles 10 may be arranged in a manner such that each ceiling tile 10 has a relatively small gap G between adjacent ceiling tiles. The gap G may vary between 0.01 inch to 0.1 inch, such that when the ceiling structure 200 is viewed from below, an exterior contour of the ceiling structure 200 appears substantially continuous. Moreover, each of the ceiling tiles 10 may be arranged in a manner so that the complex compound shapes of the edge surfaces 30 advantageously present a continuous exterior contour view of the ceiling structure 200. The exterior contour of the ceiling structure 200 may present a distinct three-dimensional pattern that is symmetric about a longitudinal mid-plane $P_1$ and a lateral mid-plane $P_2$, as shown in FIG. 8. In some implementations, the distinct three-dimensional pattern may be formed by edge surfaces 30 that are relatively straight or flat in lieu of the complex compound shapes. Further, in some implementations, the edge surfaces 30 of the ceiling tile 10 may align with adjacent edge surfaces 30 to form a 2-dimensional contour in lieu of a 3-dimensional contour.

FIGS. 8-12 further demonstrate a lighting system 250 that comprises electrical systems 20 of each ceiling tile 10, and a power block or power circuit 251. The power block 251 is generally configured to manage the supply of power from an external power supply to light sources 25 of the ceiling tiles 10. In some implementations, the power block 251 may include DC/DC power converter(s) that can couple the external power supply to supply or deliver power to the light sources 25. For instance, the DC/DC power converter(s) may step up a voltage of electrical power from the external power supply to a level sufficient to illuminate the light sources 25.

The DC/DC power converter(s) may take a variety of forms, for example an unregulated or regulated switch mode power converter, which may or may not be isolated. For instance, the DC/DC power converter(s) may take the form of a regulated boost switch mode power converter or buck-boost switch mode power converter.

The DC/DC converter(s) can include one or more buck converters, boost converters, buck-boost converters, or any combination thereof. In some situations, the DC converter(s) may include a buck converter. A buck converter can include any switched device suitable for reducing an input DC voltage to a lower output DC voltage. Typical buck converters include a switching device, for example a pulse wave modulated MOSFET or IGBT that controls the input voltage delivered to an inductor coupled in series, and a diode and a capacitor coupled in parallel with the load. In some instances, the DC/DC buck converter may include a synchronous buck converter using one or more switching devices in lieu of the diode found in a conventional buck converter. The use of one or more switching devices, such as a second MOSFET or IGBT transistor or transistor array in a synchronous buck converter, may advantageously reduce power loss attributable to the diode forward voltage drop that occurs within a standard buck converter. In some situations, at least a portion of the DC/DC converter(s) may include a boost converter. A boost converter can include any device or system suitable for increasing a relatively low input DC voltage to a higher DC output voltage.

In some implementations, the power block 251 may also include a DC/AC power converter, commonly referred to as an inverter, that couples the external power supply to supply or deliver power to the light sources 25 via the DC/DC converter(s). The DC/AC power converter may invert electrical power from the DC/DC converter(s) into an AC waveform suitable to power the light sources. The AC wave form may be single-phase or multi-phase, for example two- or three-phase AC power. The DC/AC power converter(s) may take a variety of forms, for example an unregulated or a regulated switch mode power converter, which may or may not be isolated. For instance, the DC/AC power converter may take the form of a regulated inverter.

In some implementations, the power block 251 includes one or more input and output ports 252, 253. The one or more input ports 252 may be coupled to the external power supply. The one or more output ports 253 may be coupled to an input connector 22 of one of the plurality of ceiling tiles 10. As described above, in such an implementation, an output connector 23 may thereafter be coupled to an input connector 22 of another adjacent ceiling tile 10. For example, an input port of the input connector 22 may be coupled to the output port 253 of the power block 251. An output port of the input connector 22 may be coupled to the light source(s) 25 via the splice connectors 21 and an input port of the output connector 23 via the wire connectors 24. The output port of the output connector 23 may be coupled to an input port of an input connector 22 of an adjacent ceiling tile 10. In a similar manner, the other ceiling tiles 10 may be electrically coupled to each other with one power block 251 configured to supply or deliver power to the arrangement of ceiling tiles 10, in contrast to having corresponding power blocks 251 for each ceiling tile 10.

FIGS. 13-18 illustrate a ceiling structure 300 that is generally similar to the ceiling structure 200 of FIGS. 8-12, but includes certain variations. The ceiling structure 300 includes a suspended framework 402 and a plurality of ceiling tiles 310, according to another example, non-limiting implementation. The ceiling tiles 310 are generally similar to the ceiling tile 10 but include certain variations. Each ceiling tile 310 includes an electrical system 320, components of which are generally disposed in a cavity 319, and which is configured to transmit power from an external power supply to electrical components of the ceiling tile 310. In particular, in contrast to the electrical system 20 which includes a plurality of splice connectors 21 that are electrically coupled to each other, the electrical system 320 includes a processor, for example, in the form of a printed circuit board (PCB) 393. The PCB 393 is configured to deliver or transmit power to one or more light source(s) 325. Each electrical system 320 further includes an input connector 322 and an output connector 323. The input connector 322 is configured to receive a supply of power, which may be delivered from an external power supply or from another output connector 323. The output connector 323 is electrically coupled to the input connector 322 and configured to deliver power supply to another input connector 322.

In each ceiling tile 310, each corresponding light source 325 that is generally configured to illuminate the ceiling tile 310 or an environment in which the ceiling tile 310 is located, is coupled to the PCB 393. Again, in some implementations, the light source 325 may take the form of one or more light emitting diodes (LED), e.g., Red, Green, Blue ("RGB") LEDs, that can be disposed in LED strips. In other implementations, the light source 325 may take other forms, such as incandescent lights, fluorescent lights, compact fluorescent lights, and other light emitting elements that may illuminate the ceiling tile 310, or an environment. The light source 325, for example, LED strip, is positioned between each of baffles. Again, in some implementations, the LED strips may be coupled to a base of the ceiling tile 310 via adhering, fasteners, or other coupling structures. In some implementations, the base may include recesses sized and shaped to receive the LED strips. Moreover, in some implementations, the LED strips may be positioned within housings that include one or more diffuser materials that diffuse light rays emitted by the LED strips.

As described above, the light sources 325 are configured to emit light to illuminate the ceiling tile 310 and/or an environment in which the ceiling tile 310 is located. For example, in some implementations, the light sources 325 may illuminate the ceiling tile 310 and/or the environment in a certain color, such as red, green, blue, etc. In some implementations, the light sources 325 may be configured to generate certain lighting schemes, for example, animated lighting schemes. The suspended framework 402 is generally suspended from an overhead structure (not shown) by hanging wires, braces or other structures that couple the suspended framework 402 to the overhead structure. The suspended framework 402 includes a plurality of main runners 422 that are spatially spaced apart and are substantially parallel to each other. The suspended framework 402 further includes a plurality of cross runners 424 that are spatially spaced apart and are substantially parallel to each other, but are oriented to be substantially perpendicular to the plurality of main runners 422. The main runners 422 and the cross runners 424 may be manufactured from extrusions having various cross-sectional profiles.

The cross runners 424 are coupled to the main runners 422 in a known manner. The coupling of the cross runners 424 to the main runners 422 defines tile receiving openings 410. The area of each of the tile receiving openings 410 (i.e., width and length) depends on the spacing of the main runners 422 and the cross runners 424. This spacing can be adjustable based on the areas of the ceiling tiles 310 that are to be positioned within the tile receiving openings 410, such that the ceiling tiles 310 substantially cover or overlay the tile receiving openings 410. Each tile receiving opening 410 also defines a mounting frame 428 that bounds the tile receiving opening 410 and includes mating surfaces 490 that generally face downward, i.e., facing a floor structure of an interior of a room or space. The mating surfaces 490 may be defined by base flanges of the main runners 422 and the cross runners 424, to which the ceiling tiles 310 are coupled.

The main runners 422 and the cross runners 424 are generally made from steel or other ferromagnetic materials. Thus, when the ceiling tiles 310 are positioned within the tile receiving openings 490, the magnetic force produced by magnet(s) 341 of ceiling tiles 310 is sufficient to magnetically couple the ceiling tile 310 to the suspended framework 402. In some implementations, the ceiling structure 300 may optionally include a gasket that may be positioned between the main runners 422 and the cross runners 424. The gasket may be positioned around boundaries of the ceiling tiles 310.

Figure 13:
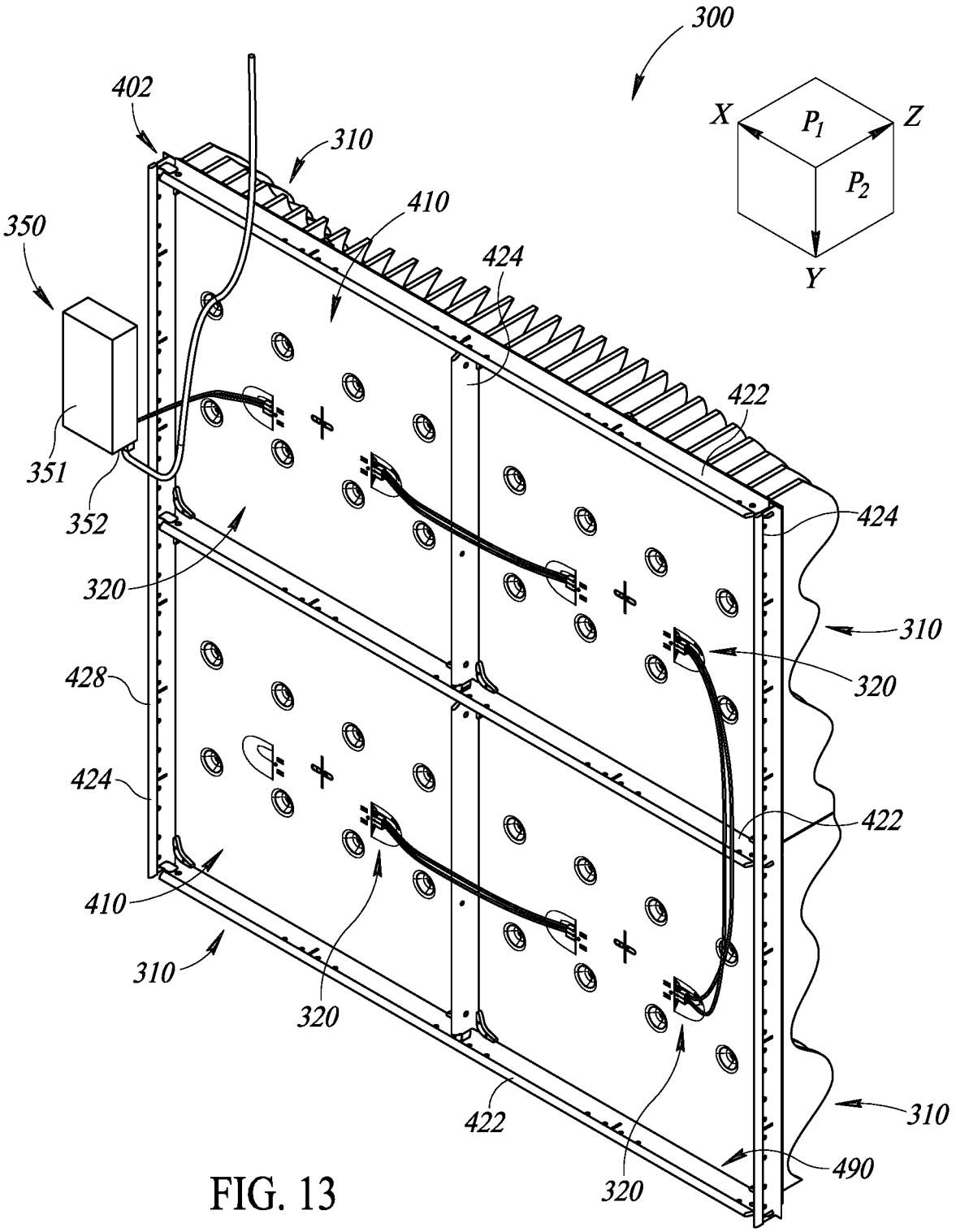
FIG. 13 is a perspective view of a ceiling structure, according to one example, non-limiting embodiment.
Figure 14:
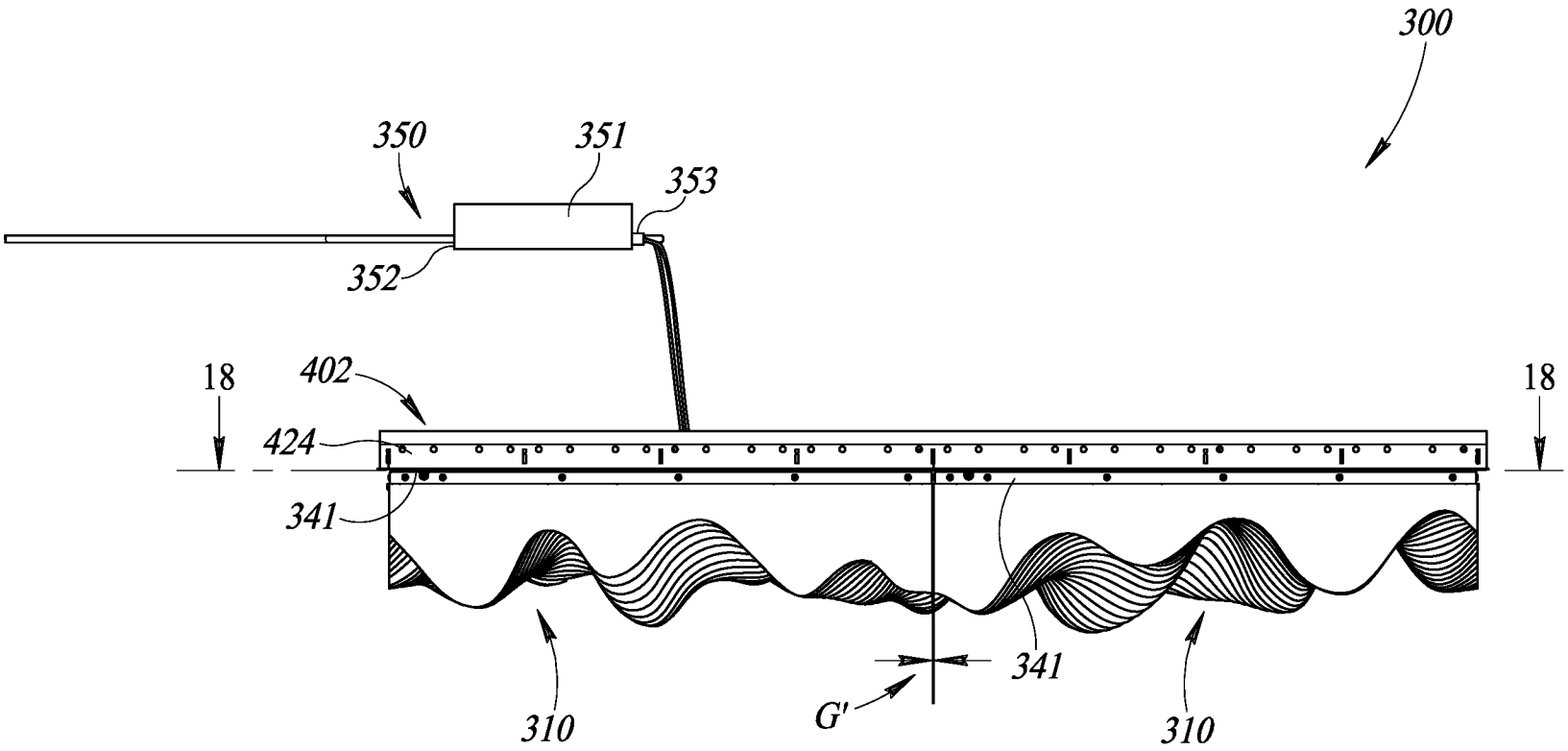
FIG. 14 is a front elevational view of the ceiling structure of FIG. 14.
Figure 15:
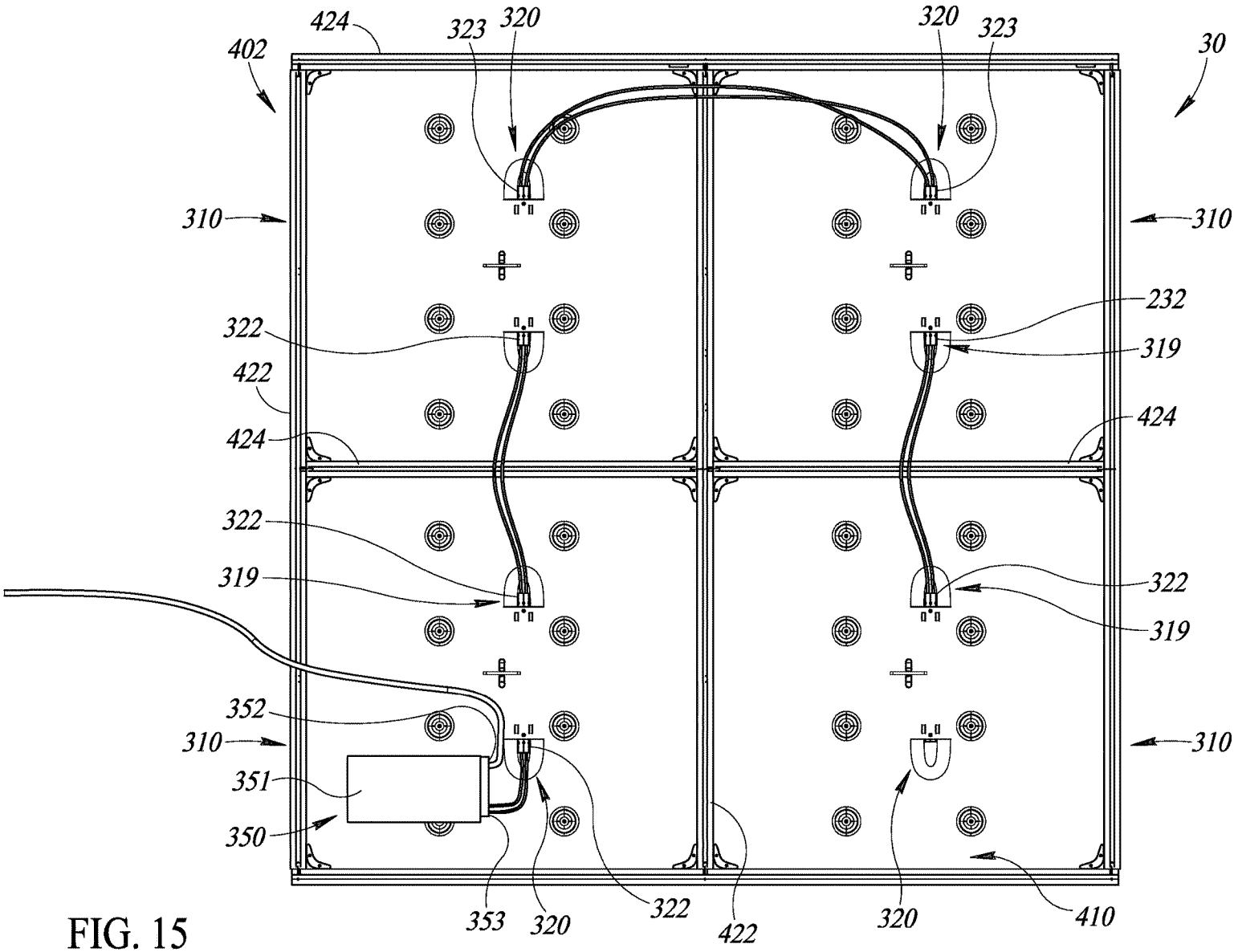
FIG. 15 is a top plan view of the ceiling structure of FIG. 13 as viewed looking down to the ceiling structure.
Figure 16:
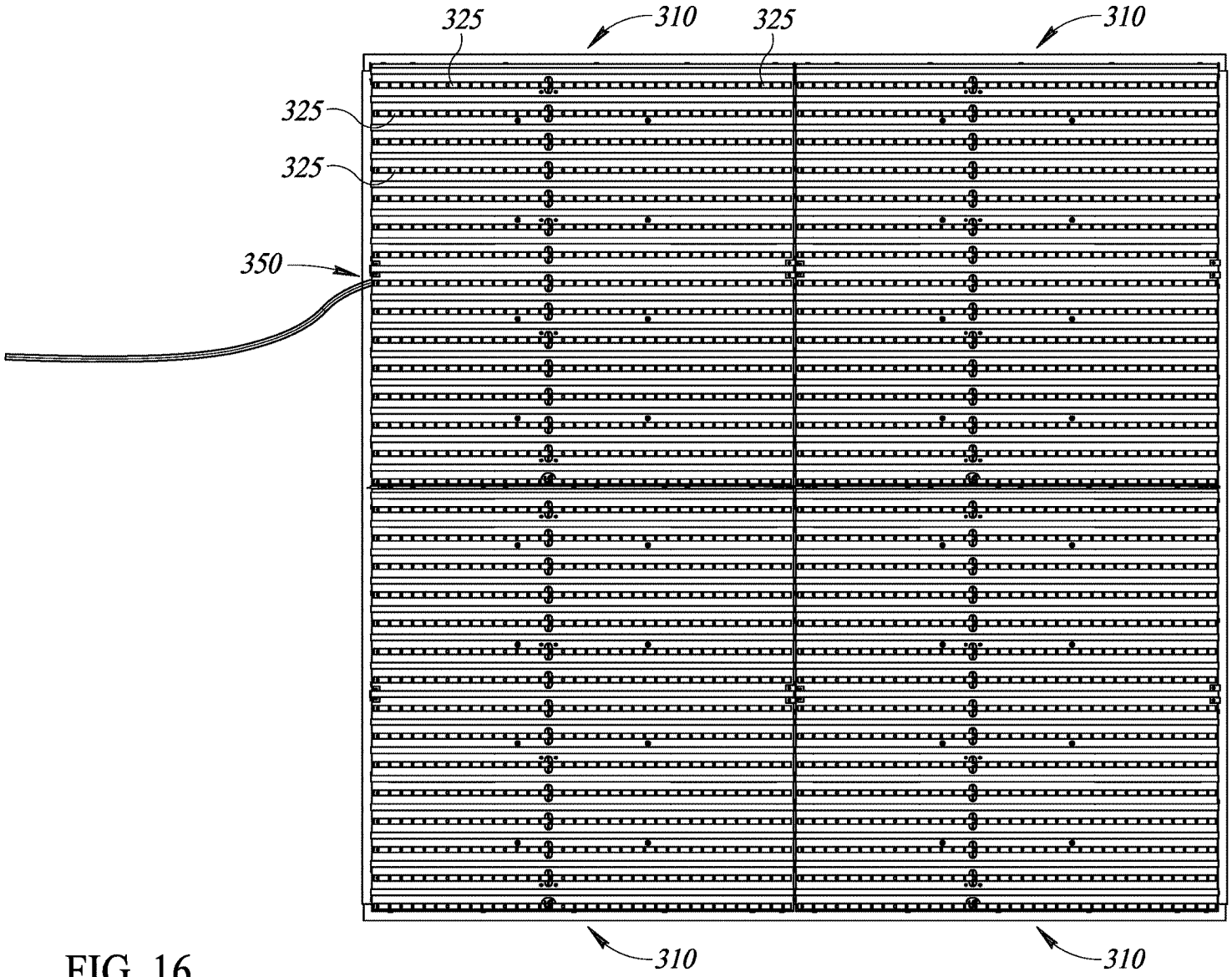
FIG. 16 is a bottom plan view of the ceiling structure of FIG. 13 as viewed looking up to the ceiling structure.
Figure 17:
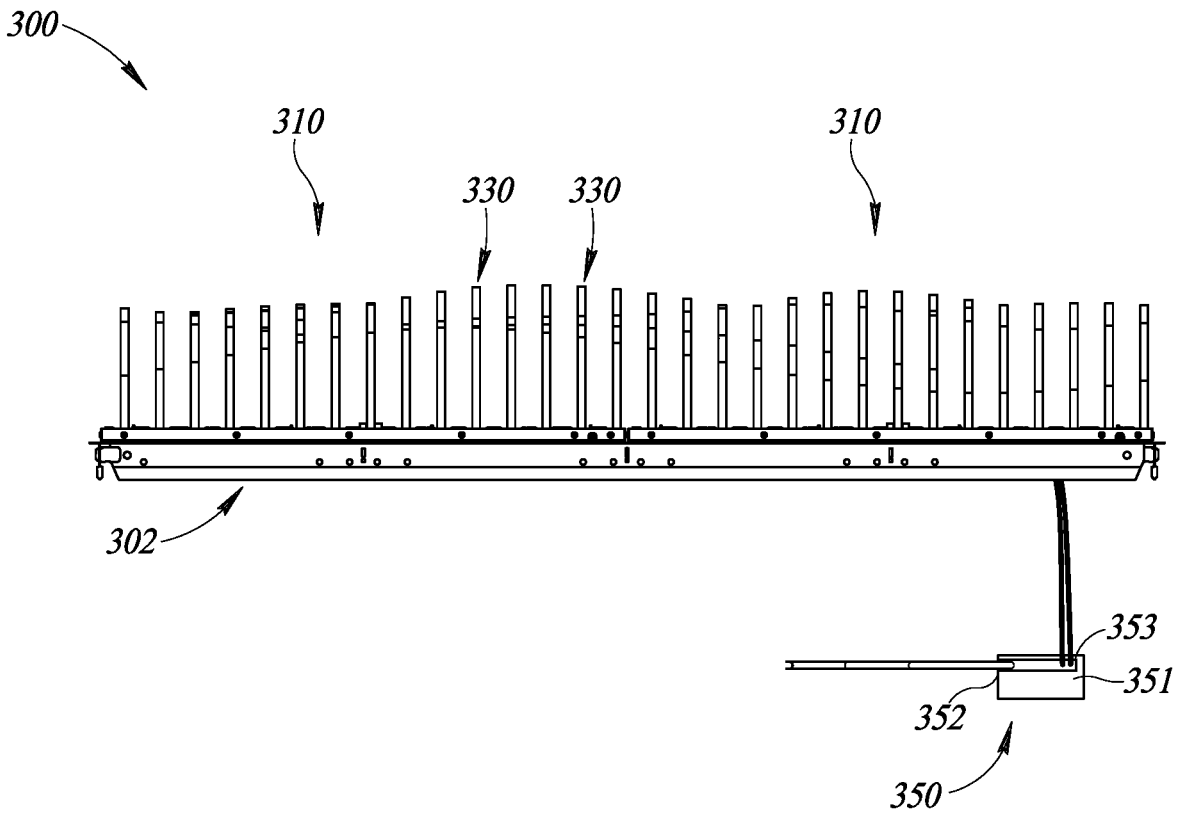
FIG. 17 is a side elevational view of the ceiling structure of FIG. 13.
Figure 18:
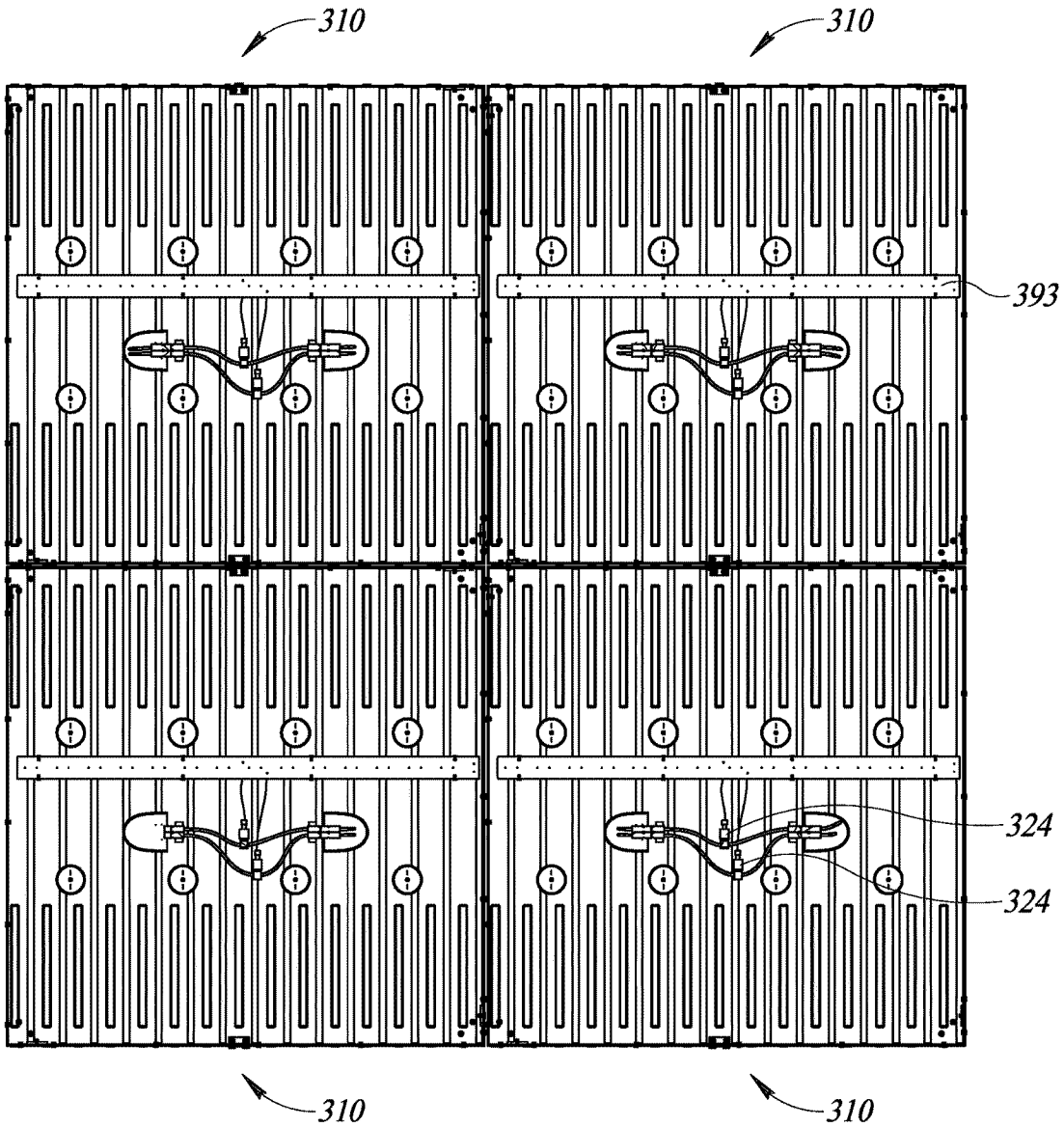
FIG. 18 is a cross-sectional view of the ceiling structure of FIG. 18, taken along line 18-18.

With continued reference to FIGS. 14 through 18, the ceiling tiles 310 may be arranged in a manner such that each ceiling tile 310 has a relatively small gap G' between adjacent ceiling tiles. The gap G' may vary between 0.01 inch to 0.1 inch, such that when the ceiling structure 300 is viewed from below, an exterior contour of the ceiling structure 300 appears substantially continuous. Moreover, each of the ceiling tiles 310 may be arranged in a manner so that the complex compound shapes of edge surfaces 330 advantageously present a continuous exterior contour view of the ceiling structure 300. The exterior contour of the ceiling structure 300 may present a distinct three-dimensional pattern that is symmetric about a longitudinal mid-plane $P_1$ and a lateral mid-plane $P_2$, as shown in FIG. 13. In some implementations, the distinct three-dimensional pattern may be formed by edge surfaces 330 that are relatively straight or flat in lieu of the complex compound shapes. Further, in some implementations, the edge surfaces 330 of the ceiling tile 310 may align with adjacent edge surfaces 330 to form a 2-dimensional contour in lieu of a 3-dimensional contour.

FIGS. 13-18 further demonstrate a lighting system 350 that is generally similar to the lighting system 250 of FIGS. 8-12. The lighting system 350 comprises electrical systems 320 of each ceiling tile 310, and a power block or power circuit 351. The power block 351 is generally configured to manage the supply of power from an external power supply to light sources 325 of the ceiling tiles 310, as described above.

Again, in some implementations, the power block 351 includes one or more input and output ports 352, 353. The one or more input ports 352 may be coupled to the external power supply. The one or more output ports 353 may be coupled to an input connector 322 of one of the plurality of ceiling tiles 310. As described above, in such an implementation, an output connector 323 may thereafter be coupled to an input connector 322 of another adjacent ceiling tile 310. For example, an input port of the input connector 322 may be coupled to the output port 353 of the power block 351. An output port of the input connector 322 may be coupled to the light source(s) 325 via the PCB 393 and an input port of the output connector 23 via wire connectors 324. The output port of the output connector 323 may be coupled to an input port of an input connector 322 of an adjacent ceiling tile 310. In a similar manner, the other ceiling tiles 310 may be electrically coupled to each other with one power block 351 configured to supply or deliver power to the arrangement of ceiling tiles 310, in contrast to having corresponding power blocks 351 for each ceiling tile 10.

Figure 19:
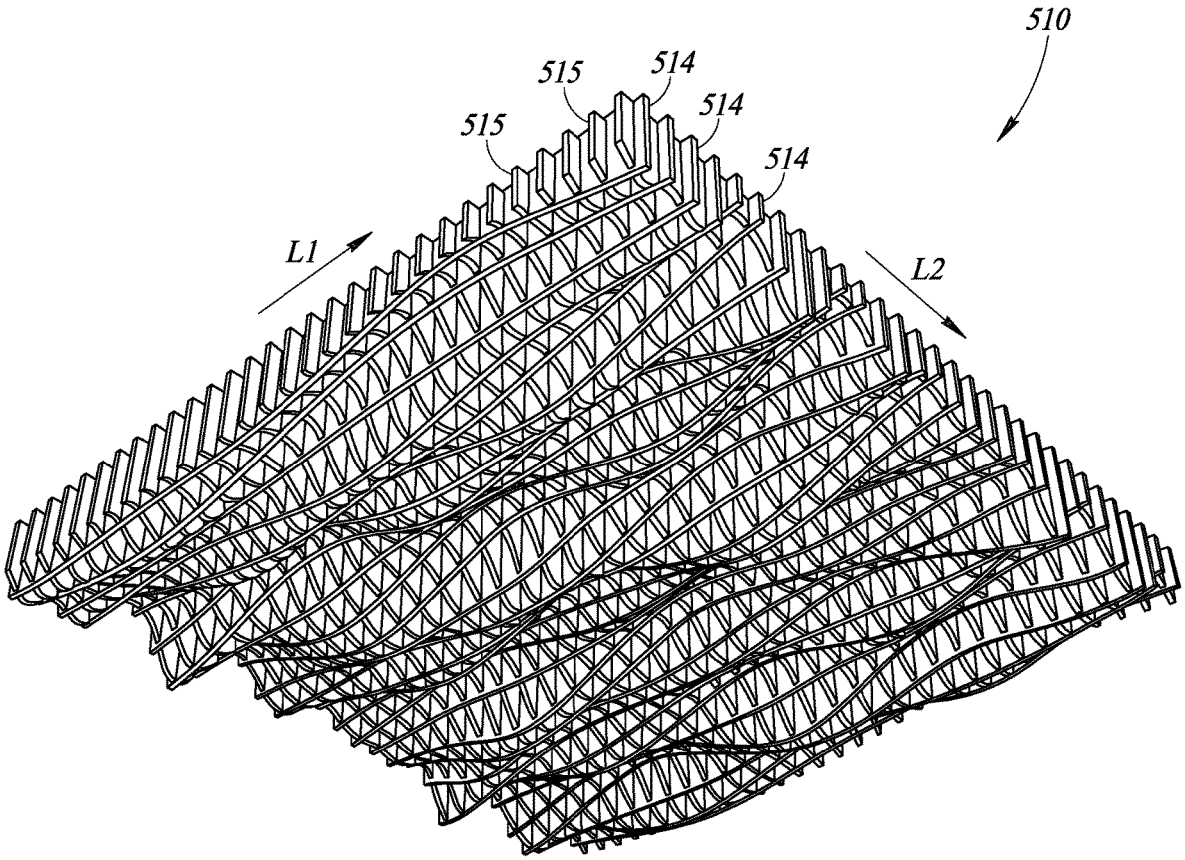
FIG. 19 is a perspective view of an arrangement of ceiling tiles, according to another example embodiment.

FIG. 19 illustrates an arrangement of ceiling tiles 510 according to another example implementation, for example, an arrangement of 4 ceiling tiles 510. Each ceiling tile 510 is generally similar to the ceiling tile 10, but includes certain variations. For example, the ceiling tile 510 includes a plurality of baffles 514 that extend in an L1 direction, the baffles 514 being generally similar to the baffles 14, and a plurality of baffles 515. The baffles 515 extend perpendicularly to the baffles 514, in an L2 direction. In some implementations, the baffles 515 are coupled to the baffles 514, and are arranged to be positioned away from light sources, e.g., LEDs 27.

Moreover, the various embodiments or implementations described above can be combined to provide further embodiments or implementations. These and other changes can be made to the embodiments or implementations in light of the above-detailed description. In general, in the following claims, the terms used should not be construed to limit the claims to the specific embodiments or implementations disclosed in the specification and the claims, but should be construed to include all possible embodiments or implementations along with the full scope of equivalents to which such claims are entitled. Accordingly, the claims are not limited by the disclosure.

The invention claimed is:

1. A ceiling structure comprising:

a suspended framework having a plurality of main runners and a plurality of cross runners interconnected to define an array of tile receiving openings, each of the plurality of main runners and the plurality of cross runners including a tile mating surface facing downward to define a mounting frame at each respective tile receiving opening; and a plurality of ceiling tiles positioned within the array of tile receiving openings, each of the plurality of ceiling tiles having a main body, the main body including:

a base having a periphery;

a plurality of magnets positioned at the periphery and sized and shaped to magnetically couple the ceiling tile within a respective one of the tile receiving openings;

a plurality of baffles coupled to the base, each baffle being spaced apart from the other to define an acoustical gap; and one or more light sources coupled to the base of each ceiling tile and positioned in the acoustical gap.

2. The ceiling structure of claim 1 wherein the one or more light sources comprise a light emitting diode strip.

3. The ceiling structure of claim 1, further comprising an electrical system, the electrical system including:

a power block coupleable to an external power source; and an input connector having an input port coupled to the power block and an output port coupled to a light source, the light source positioned between the baffles.

4. The ceiling structure of claim 1, further comprising an electrical system, the electrical system including:

a power block coupled to an external power source;

an input connector disposed on each ceiling tile and coupled to light sources of the ceiling tiles, only a first one of the input connectors coupled to the power block; and an output connector disposed on each ceiling tile and coupled to the input connector disposed on each ceiling tile, the output connector further coupled to an input connector of an adjacent ceiling tile.

5. The ceiling structure of claim 1 wherein the periphery of the base includes a plurality of receptacles, the receptacles sized and shaped to receive the magnets.

6. The ceiling structure of claim 5 wherein the magnets comprise at least one of square or rectangular magnets, and radial magnets.

7. A ceiling tile, comprising:

a base having a periphery;

one or more magnets positioned at the periphery and sized and shaped to magnetically couple the ceiling tile to a ceiling structure;

a plurality of baffles coupled to the base, each baffle being spaced apart from the other to define an acoustical gap; and a light source coupled to the base and positioned between the baffles in the acoustical gap.

8. The ceiling tile of claim 7, further comprising:

an input connector having a port that is sized and shaped to electrically couple the light source to an external power supply.

9. The ceiling tile of claim 7 wherein the light source comprises a light emitting diode strip.

10. The ceiling tile of claim 7 wherein the baffles include an edge surface that forms an arcuate shape.

11. The ceiling tile of claim 7 wherein each baffle has an edge surface that forms a shape of the baffle that is different from a shape of another baffle.

12. The ceiling tile of claim 7 wherein the base includes pairs of cavities spaced apart in a longitudinal direction and each baffle includes a pair of tabs, the cavities sized and shaped to coupleably receive the tabs of the baffles.

13. A method for assembling a ceiling structure, the method comprising:

constructing a suspended framework having a plurality of main runners and a plurality of cross runners interconnected to define an array of tile receiving positions;

magnetically coupling a plurality of ceiling tiles to the suspended framework with a respective ceiling tile located at each tile receiving position;

coupling a plurality of baffles to a base of the ceiling tiles, each baffle being spaced apart from the other baffle to define an acoustical gap;

coupling a light source to at least one of the plurality of ceiling tiles, the light source configured to illuminate an environment in which the ceiling tiles are located, the light source positioned between the baffles in the acoustical gap; and electrically coupling the light source to an external power supply.

14. The method of claim 13, comprising:

coupling a plurality of light sources to each ceiling tile, the light sources being positioned between baffles of the ceiling tile in the acoustical gap.

15. The method of claim 13, comprising:

arranging the ceiling tiles on the suspended framework such that each ceiling tile aligns with an adjacent ceiling tile such that a three-dimensional contour is maintained across an interface of adjacent ceiling tiles.

16. The method of claim 13 wherein magnetically coupling the plurality of ceiling tiles to the suspended framework includes coupling a plurality of square or rectangular magnets or radial magnets along a periphery of the ceiling tile.

17. The ceiling structure of claim 1 wherein each of the baffles extends longitudinally parallel to the cross-runners, and the baffles are spaced apart laterally parallel to the main runners to define the acoustical gap.

* * * * *